United States Patent [19]

Nestlen et al.

[11] Patent Number: 4,709,219

[45] Date of Patent: Nov. 24, 1987

[54] SMALL-SIZE SWITCHING RELAY IN MINIATURE EMBODIMENT

[75] Inventors: Wolfgang Nestlen, Rottweil; Reiner Rudolf, Fridingen, both of Fed. Rep. of Germany

[73] Assignee: Hengstler GmbH Geschäftsbereich Haller-Relais, Wehingen, Fed. Rep. of Germany

[21] Appl. No.: 639,427

[22] Filed: Aug. 10, 1984

[51] Int. Cl.[4] ..... H01H 51/08

[52] U.S. Cl. ..... 335/129; 335/135; 335/202

[58] Field of Search ..... 335/129, 135, 202

[56] References Cited

U.S. PATENT DOCUMENTS 4,420,733 12/1983 Palandri ..... 335/135

FOREIGN PATENT DOCUMENTS 2614942 10/1977 Fed. Rep. of Germany .

2717293 12/1979 Fed. Rep. of Germany .

*Primary Examiner*—Harold Broome

*Attorney, Agent, or Firm*—Ross, Ross & Flavin

[57] ABSTRACT

In a miniaturized electromagnetic relay wherein an insulation is provided in a housing separating the magnet and contact system, there are provided a rib integral with the housing having a dogleg for partially encapsulating the armature and a pocket on the actuator for the nesting of a free swivelling end of the armature.

3 Claims, 4 Drawing Figures

SMALL-SIZE SWITCHING RELAY IN MINIATURE EMBODIMENT

Figure 1:
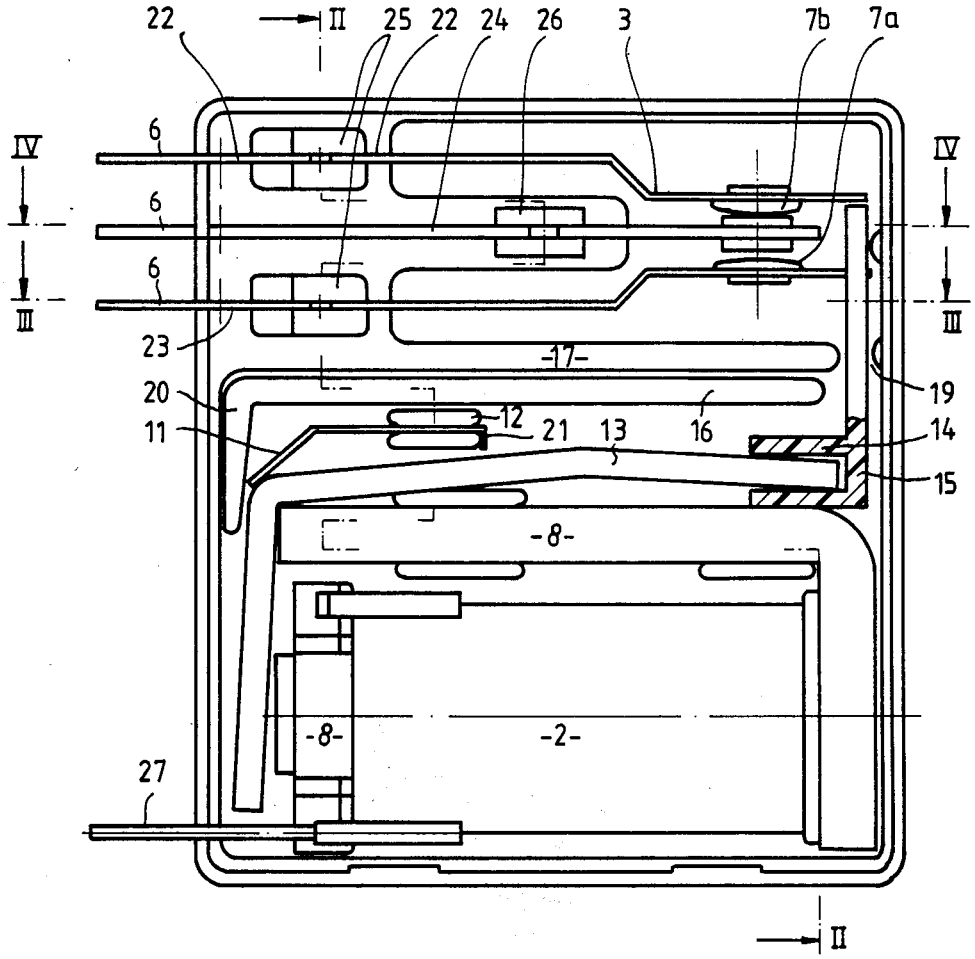

The invention relates to a small-size switching relay with increased insulation between a magnet system and a contact system, the relay consisting of a case housing a spring support, a magnet system, and a contact system. The case is provided with a sealing cover.

A small-size switching relay, is produced in several embodiments. All known embodiments have the disadvantage that certain minimum dimensions cannot be diminished. Conventional external dimensions are, for example, 27.9×24.7×10.4 mm. A diminishing of these dimensions was, until now, not impossible because, on the one hand, an increased insulation was required, and, on the other hand, the contact system including the holders for the contact springs was manufactured separately from the case because of the insulation measures and constructional reasons.

It is, therefore, an object of the present invention to develop a small-size switching relay of the above mentioned type in order to use it as a card-relay which can be mounted, for example, side by side in a standard grid of 5 mm.

For the solution of the problem posed, the invention is characterized in that the sring support forms a homogeneous workpiece with the trough-shaped case being opened at one side.

One feature of the invention is that there is a trough-shaped spring support in which are arranged a chambered magnet system and a chambered contact system. A closure or cover is snapped into the closing position.

The usual height of the unit is controlled by the electronic components and by the plug-in cards; as to the present relay in lying position, the maximum height of 7.9 mm has been reduced for the first time. That means that the relay, according to the invention, is the first small-size switching relay for power current in such an extremely flat embodiment.

In an upright embodiment, this relay can also be mounted side by side as the first relay in a standard grid of 5 mm.

In contrast to known relays, the present relay, also in the embodiment 1 (contact changer), has air gaps and creeping distances of more than 8 mm, i.e. it has a better insulation. Up to now, such relays with large dimensions were only known as in the embodiment (1) (contact maker).

The present relay is conceived so that the watertight version (IP 67) has the same external dimensions as the open version (IP 40).

As the salient features of the invention, we claim the combination of a miniaturization of known card-relays with the special features of the increased insulation (8 mm) as well for the upright and the laying embodiment as for the open and sealed version.

The obtained unit height of 7.9 mm comes about as follows:

Distance circuit board/circuit board ½ inch (=12.7 mm), common thickness of circuit boards 1.5 to 3.2 mm, unit height of relay 7.9 mm; these dimensions still allow pin lengths of 1.6 mm on the backside of the circuit board for soldering purposes. This pin length is normally necessary for a good bath soldering.

By the feature that the spring support is forming a homogeneous workpiece with the trough-shaped case opened at one side, results the required miniaturization.

The spring support is, in the language of the present day, the holding element for all parts of the relay, especially for the contact system and the magnet system. If now the spring support is forming a homogeneous workpiece with the case, the result is that a separate arrangement of holding elements and cases will be avoided; instead of this, the holding elements are integrated in the case itself. The case is preferably made of an injection-molded plastic material. Thus the contact system and the magnet system are directly inserted and fixed in the case. The pre-mounting with the aid of suitable holding devices would only request additional and undesired space.

The mounting of the magnet assembly is made by a simple pushing of the exciting coil including core and yoke into the case, the holding spring of the armature being attached to a holder in the case. To reach the air gaps and creeping distances of 8 mm, the armature must be embedded into a pocket of the actuating element.

The total construction renders possible an automatic production.

The technical characteristics of the small-size switching relay are as follows:

The relay is a real small-size switching relay with increased insulation between coil and contacts of $K/L > 8\ mm \hat{=} > 4\ kV$. The relay can be used in all cases where the distances between circuit boards and module widths don't allow wider relays without renunciation of the charasteristic features of a small-size switching relay. This relay has been developed on the base of the German prescriptions VDE 0110, VDE 0435, VDE 0631, VDE 0730, VDE 0804, and VDE 0860.

Contacts:

Equipment: 1 contact-maker (1) or 1 contact-breaker (2) or 1 contact-changer (21)

Material: AgCdO, AgCu-Aup (single or twin contact)

Max. Switching Voltage: 380 $V_{AC}$

Max. Switching Current: 6 A, Permanent Current: 8 A

Contact Resistance: 100 mOhm/50 mOhm.

Other Characteristics:

Ambiant Temperature: −40° C. to +70° C.

Max. Switching Frequency: 20 Hz

Mechanical Life Expectancy: $2\times10^7$

Electrical Life Expectancy: $2\times10^5$

Testing Voltage (Coil-Contact): 4 $kV_{eff}$

Air Gap/Creeping Distance (Coil-Contact) >8 mm

Insulation according to VDE 0110: IGr C/250-B/380 in watertight version: IGr C/380.

The object of the present invention does not result only from the objects of the individual claims but also from the combination of claims one another. We claim all disclosed data and features, especially the embodiment shown in the drawings so far as they are novelties with regard to the prior art, individually or in combination.

The invention will now be explained by means of one embodiment illustrated by drawings. Other essential features and advantages of the invention are resulting from the drawings and from its descriptions.

DRAWINGS

Figure 2:
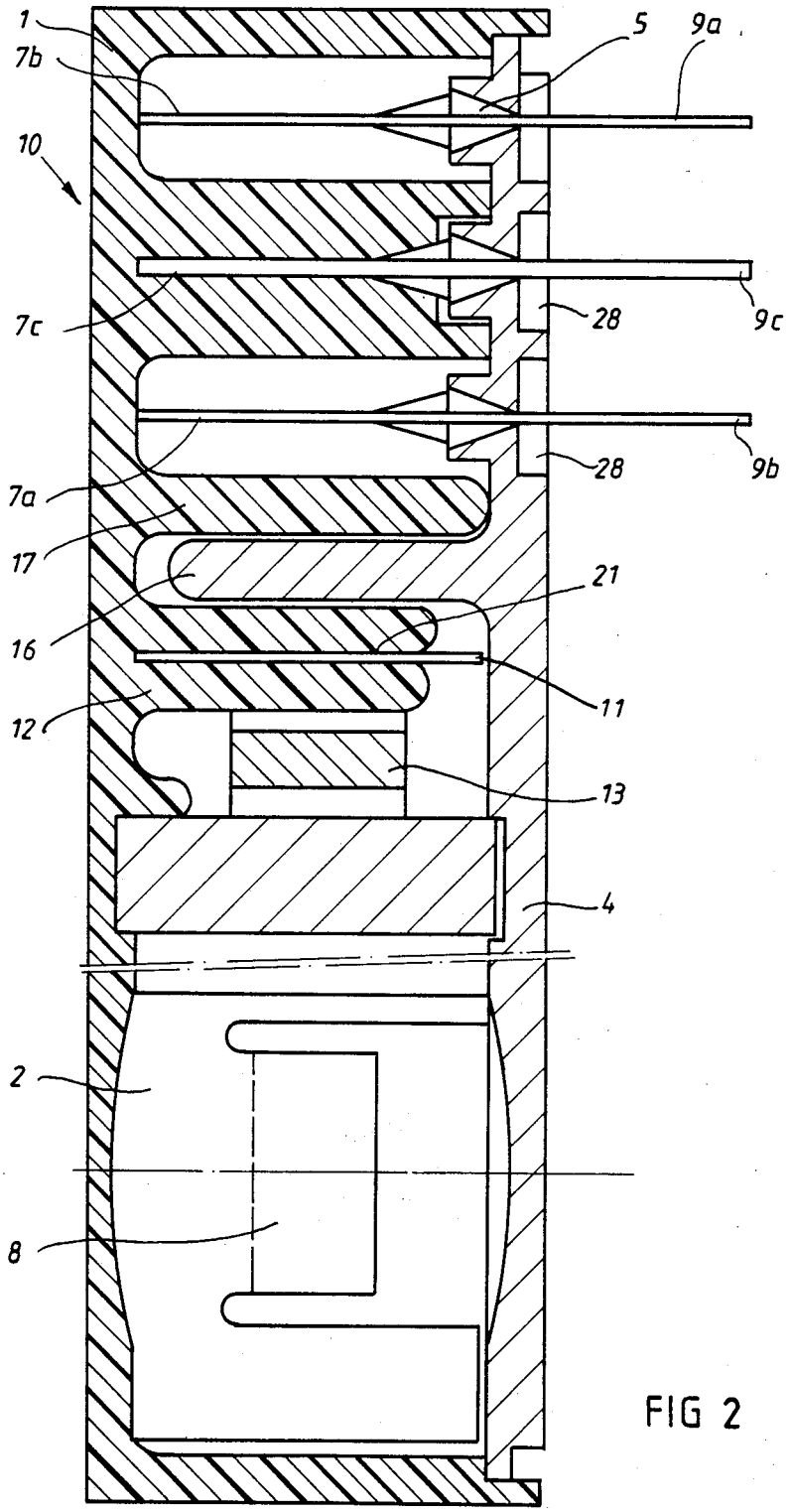
Figure 3:
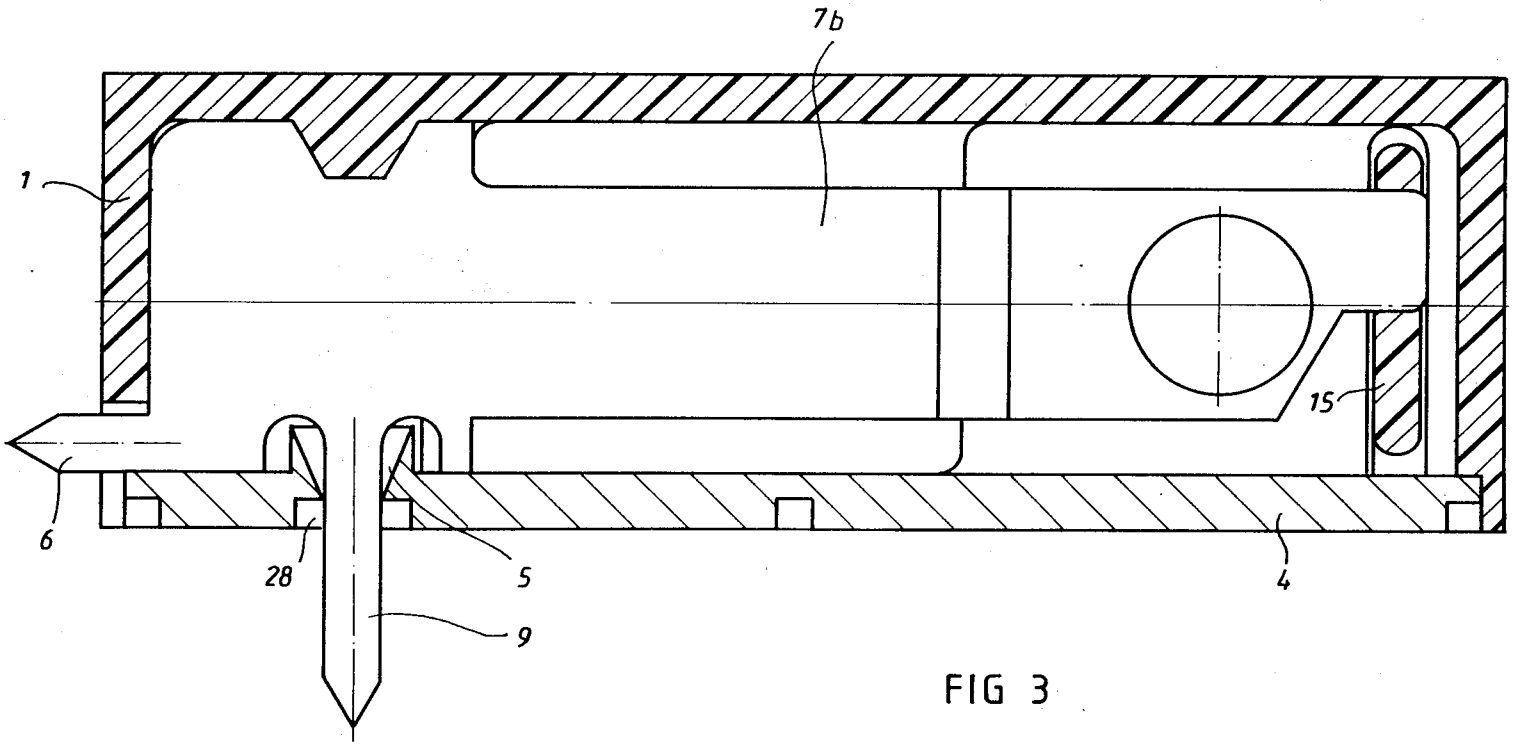
Figure 4:
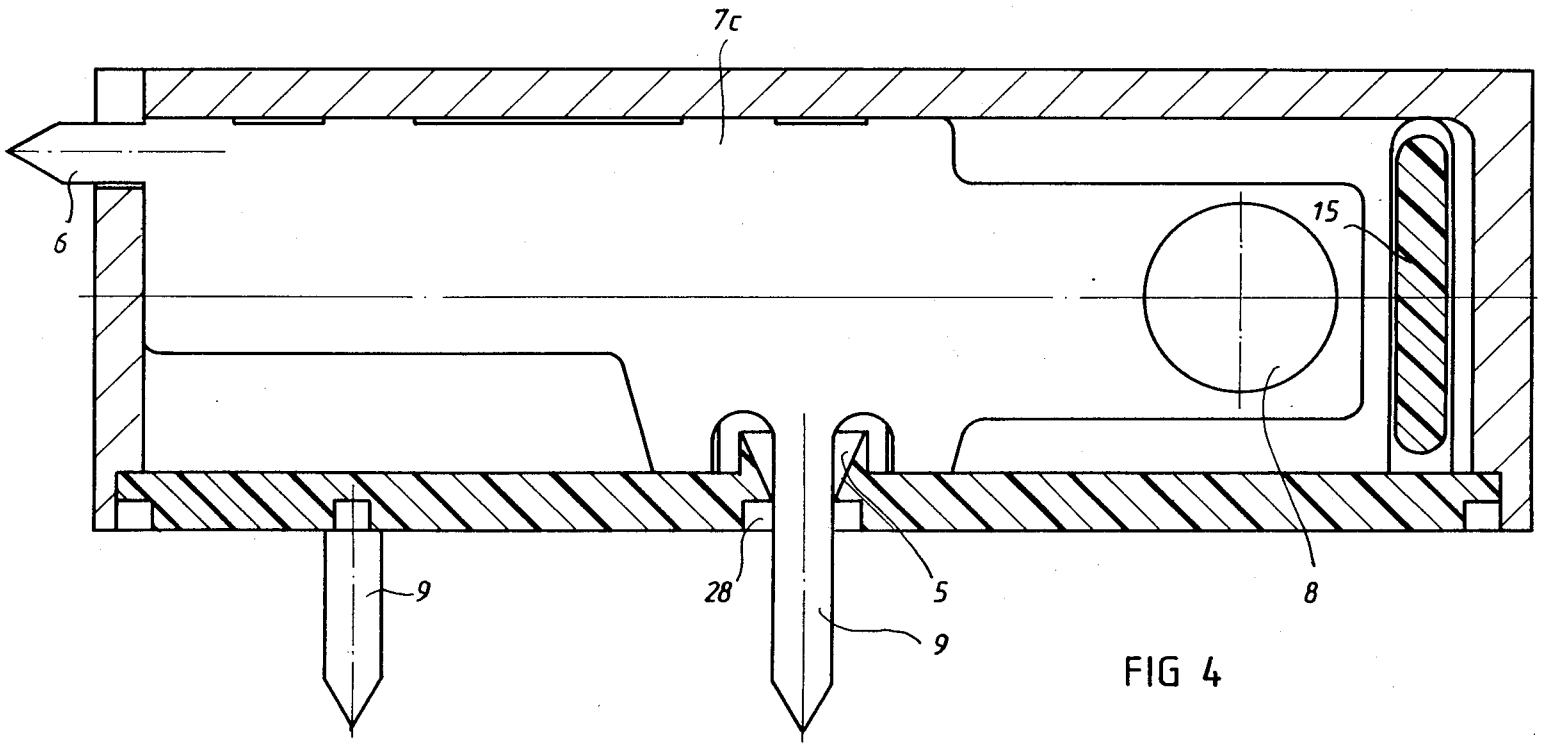

FIG. 1 is a longitudinal section through a relay according to the invention, FIG. 2 is a section according to the line II—II in FIG. 1, FIG. 3 is a section according to the line III—III in FIG. 1, FIG. 4 is a section according to the line IV—IV in FIG. 1.

The relay according to the FIGS. 1 to 4 consists of a trough-shaped case 10 which simultaneously serves as spring support 1 for the holder of the magnet system 2 and the contact system 3.

The magnet system 2 consists of an excitation coil at which the yoke and the core 8 are an only part formed by punching and simultaneous bending with the shape of an U. As to the advantages connected with this way of manufacture, we refer to the German patent application No. P 33 24 246.1 of the same applicant. The disclosure of this patent application shall be totally integrated into the present patent application.

The complete magnet system 2 is only laid in the case, the connections 27 passing the case through lateral slots. The magnet system is only laid in the case and is protected from falling out by the cover 4 which is pressed onto the case and held down by snapping-in. Another protection of the position of the magnet system 2 is obtained by a holding spring 11 of the armature, squeezed in the slot 21 of a holder 12. In FIG. 2 it is shown that the holder 12 forms a homogeneous workpiece on the bottom of the case 10. The holding spring of the armature is the abutment of the armature 13 which is swingingly put on the yoke, and the back, free and swinging end of which is inserted into a pocket 14 of the actuating element 15; this is made for insulation reasons. The actuating element 15 is passing a small opening 19 in the chamber wall 17 separating the magnet system 2 from the overlying contact system 3. In the shown embodiment, the contact system 3 consists of two switching springs 7*a*, 7*b* which, when occasion arises, come into contact with the contact spring 7*c*, depending on the position of the armature 13.

The switching springs 7*a*, 7*b* being in corresponding slots 22, 23 of the case, for which several slots 22 or 23 respectively are provided, arranged one after another and separated by a notch 25.

The contact spring 7*c* is also guided by a slot 24 in the case 10 and is also passing a notch 26. The securing of the position of the springs 7*a*, 7*b*, 7*c* is then obtained in the region of the notches 25, 26.

The springs 7*a*, 7*b*, 7*c* are guided outwards by connectors 9*a*, 9*b*, 9*c*; at this it is important that, in the case of the lying embodiment, the connectors pass the cover 4 and that the cover, in the region of the connectors, is provided with conical openings 5. More than that, the cover is provided, on the outside, with pockets 28 with deepened diameter. As to the signification of the conical openings 5 and to the pockets 28, we refer to the German patent application No. P 33 19 329.0 of the same applicant. The there made disclosure shall be totally integrated in the disclosure of the present patent application.

As to the present embodiment, it is essential that, by the arrangement of conical openings 5, the soldering flux is passing at first the region of the connectors 9 through the corresponding opening in the cover 4 and, after that, is sealing the connector 9. Hereby it is avoided that, in the case of adhering of the connectors 9 to the cover 4, adhesive material can pass into the interior of the relay. All pockets 28 are communicated by corresponding channels so that, when adhesives are brought into one pocket, the adhesive is distributed by channels and can reach and fill all other pockets 28. In this way, all connectors 9 can be sticked to the cover 4 by one single insertion of adhesive.

Alternatively, in the FIGS. 1, 3 and 4 is shown that, instead of the connectors 9, according connection pins 6 may be provided for an upright embodiment; these pins are then passing one side of the case 10.

It is important that, on the underside of the cover 4, there is provided a rib 16, directly lying on the chamber wall 17. Thus a double separation of the contact system 3 from the magnet system 2 is warranted. Furthermore it is important that the rib 16 is nearly reaching the bottom of the case 10, as shown in FIG. 2.

To insulate the armature 13 sufficiently, the rib 16 is provided with an angle 20 which partially embraces the excitation coil of the magnet system 2 and overlaps the holding spring 11 of the armature.

The asked miniaturization results by the arrangement of all fixing elements for the magnet system 2 and the contact system 3 in one case, all holding elements (for the spring support 1) forming a homogeneous workpiece with the case 10.

SUMMARY

The small-size switching relay has an increased insulation between magnet system and contact system and is used as miniature card-relay, the spring support forming a homogeneous workpiece with the trough-shaped case which is opened at one side. By this, the relay is usable in a standard grid of 5 mm and has the features of a small-size switching relay for power current in extremely flat embodiment.

KEY FOR DRAWINGS

1 Spring Support
2 Magnet System
3 Contact System
4 Cover
5 Opening
6 Connection Pin
7*a* Switching Spring
7*b* Switching Spring
7*c* Contact Spring
8 Yoke and Core
9*a* Connector
9*b* Connector
9*c* Connectór
10 Case
11 Holding Spring (Armature)
12 Holder (for 11)
13 Armature
14 Pocket
15 Actuating Element
16 Rib (Cover)
17 Chamber Wall
19 Opening
20 Angle (Rib 1*b*)
21 Slot (Holder 12)
22 Slot (Switching Spring 7*a*)
23 Slot (Switching Spring 7*b*)
24 Slot (Contact Spring 7*c*)
25 Notch (Spring Support 1)
26 Notch (Spring Support 1)
27 Connections
28 Pockets

We claim:

1. In a miniaturized electromagnetic relay, the combination of, a magnet system including an L-shaped armature having a free swivelling end, a contact system, including contact springs, a casing, a cover cooperant with the casing, the casing defining a spring support for retaining the magnet and contact systems within the casing and cooperant cover, a rib integral with the cover for separating the magnet and contact systems, an actuator for actuating the contact springs of the contact system, the rib being provided with a dogleg for partially surrounding the armature, the actuator being provided with a pocket for nestably receiving the free swivelling end of the armature.

2. In the relay of claim 1, with the rib on the cover there being slots and recesses in the spring support for retaining the contact springs, and a chamber wall extending inwardly from and integral with the casing and in abutment with the rib of the cover.

3. In the relay of claim 1, a spring for holding the armature, there being a holder projection extending inwardly from and integral with the casing for retaining the armature holding spring.

* * * * *